US006297774B1

(12) United States Patent
Chung

(10) Patent No.: US 6,297,774 B1
(45) Date of Patent: Oct. 2, 2001

(54) LOW COST HIGH PERFORMANCE PORTABLE PHASED ARRAY ANTENNA SYSTEM FOR SATELLITE COMMUNICATION

(76) Inventor: Hsin- Hsien Chung, 12388 Picrus St., San Diego, CA (US) 92129

( * ) Notice: Subject to any disclaimer, the term of this patent is extended or adjusted under 35 U.S.C. 154(b) by 0 days.

(21) Appl. No.: 08/820,435

(22) Filed: Mar. 12, 1997

(51) Int. Cl.[7] ..... H01Q 3/02
(52) U.S. Cl. ..... 343/700; 343/853; 343/776
(58) Field of Search ..... 343/700 MS, 853, 343/776, 771; H01Q 1/36

(56) References Cited

U.S. PATENT DOCUMENTS

| | | | | |
|---|---|---|---|---|
| 4,618,865 | | 10/1986 | Lamensdorf et al. | 343/776 |
| 4,755,821 | | 7/1988 | Itoh et al. | 343/700 MS |
| 4,761,653 | * | 8/1988 | Owens et al. | 343/705 |
| 4,903,033 | * | 2/1990 | Tsao et al. | 343/700 MS |
| 5,243,357 | * | 9/1993 | Koike et al. | 343/776 |
| 5,278,569 | | 1/1994 | Ohta et al. | 343/700 MS |
| 5,434,581 | * | 7/1995 | Ranguenet et al. | 343/700 MS |
| 5,475,394 | | 12/1995 | Kohls et al. | 343/700 MS |
| 5,734,354 | * | 3/1998 | Twelves | 343/815 |

FOREIGN PATENT DOCUMENTS 41 02 846 A1 8/1992 (DE) .

OTHER PUBLICATIONS

IEEE Antennas and Propagation Society International Symposium, 1993 International Symposium Digest Antennas and Propagation vol. 3, Institute of Electrical and Electronics Engineers, The University of Michigan Jun. 28–Jul. 2, 1993, pp. 1620–1623—Dual Circular Polarized Radial Line Slot Antennas, M. Takahaski, K. Yamamoto, M. Ando and N. Goto, Dept. of Electrical and Electronic Engineering, Tokyo Institute of Technology and Y. Numano, M. Suzuki, Y. Okazaki and T. Yoshimoto, Toppan Printing Co., Ltd., Tokyo, Japan.

(List continued on next page.)

*Primary Examiner*—Michael C. Wimer
(74) *Attorney, Agent, or Firm*—Fulbright & Jaworski L.L.P.; Robert Berliner

(57) ABSTRACT

A high performance phased array antenna system for receiving satellite communication signals, with a structural top layer formed as a perforated plate (or solid plate made of very low loss plastic material), a middle layer functioning as the single layer antenna aperture layer, preferably in the form of a single layer printed circuit board on which is formed an array of antenna elements and plurality of stripline feed network circuits, each combining in-phase outputs from several adjacent antenna elements, the bottom layer functioning as the ground plane for the antenna aperture layer and also including a single level waveguide combining network for combining in-phase outputs from stripline feed network circuits electromagnetically coupled to respective transition probe holes of the waveguide combining network. Each antenna element is preferably a dual polarization octagonal patch antenna element disposed on a common surface of the antenna aperture layer. Each feed network circuit is preferably in a form of an air-stripline feed network separated by a layer of air dielectric from the ground plane and preferably is on the same surface of the antenna aperture layer as the antenna elements. The single level waveguide combining network is preferably an integral structure including dual orthogonal polarization waveguide sections and dual orthogonal polarization ports. The dual orthogonal polarization waveguide sections lay in the same plane and preferably are asymmetrically disposed on either side of a common wall, with each containing a branched cavity symmetrically disposed about a respective centerline.

28 Claims, 8 Drawing Sheets

OTHER PUBLICATIONS

IEEE Antennas and Propagation Society International Symposium, 1993 International Symposium Digest Antennas and Propagation vol. 2, Institute of Electrical and Electronics Engineers, The University of Michigan Jun. 19–24, 1994, pp. 806–809—Characteristics of Dual Circularly Polarized Radial Line Slot Antennas, M. Takahashi, M. Ando and N. Goto, Dept. of Electrical and Electronic Engineering, Tokyo Institute of Technology.

IEEE Antennas and Propagation Society International Symposium, 1994 international Symposium Digest Antennas and Propagation vol. 3, Institute of Electrical and Electronics Engineers, The University of Michigan Jun. 19–24, 1994, pp. 2204–2207—Measured Performances aof a Wide Band Radial Line Slot Antenna, T. Yamamoto, M. Takahashi, M. Ando and N. Goto, Dept. of Electrical and Electronic Engineering, Tokyo Institute of Technology.

IEEE Antennas and Propagation Society International Symposium, 1995 Digest, vol. Four, Jun. 18–23, 199, Newport Beach, California, Held in conjunction with USNC/URSI National Radio Science Meeting, pp. 1990–1993—A Concentric Array Wide–Ban Radial Line Slot Antenna with Matching Terminating Slots, Tetsuya Yamamoto, Makoto Ando, Naohisa Goto, Dept. of Electrical and Electronic Engineering, Faculty of Engineering, Tokyo Institute of Technology.

Handbook of Microstrip Antennas, vol. 2, Edited by J.R. James & P. S. Hall, pp. 1112–1121 and 1148–1151 Applications in Mobile and Satellite Systems.

* cited by examiner

LOW COST HIGH PERFORMANCE PORTABLE PHASED ARRAY ANTENNA SYSTEM FOR SATELLITE COMMUNICATION

BACKGROUND OF THE INVENTION

1. Field of the Invention

The present invention relates generally to the field of antenna systems for satellite communication and more particularly to small, portable, inexpensive, lightweight planar phased array antenna systems for transmission and reception of microwave signals.

2. Brief Description of the Prior Art

Satellite communication is getting more popular in the 1990's. Arrangements typically utilized for reception of Direct Broadcast Satellite (DBS) television signals include parabolic reflector dish antennas, used as front end antennas for residential homes and offices. Presently, these antennas are bulky, require a lot of mounting space, and are obtrusive looking, thus corrupting the harmony of our living environment. Lately however, portable and more user friendly satellite antenna systems are becoming popular, due to ever increasing demands for higher living standards by our highly mobile, dynamic society, and to the advances in modern science.

Typically, a modern portable communication system for DBS signals consists of a planar network of antenna elements serving to transfer signal energy from antenna circuits to space and, conversely, from space to antenna circuits.

The major difficulty in the design of antennas for reception of DBS television signals is obtaining sufficient reduction in size and weight, while having a gain high enough to be competitive with popular parabolic reflector dish antennas. A typical antenna for reception of DBS signals requires a carrier frequency of around 12 GHz (between 12.2 GHz and 12.7 GHz in the U.S.A.) and a gain of around 33.5 dBi. The typical planar antenna system is made as an array of such small antenna elements, in order to provide sufficient energy for satisfactory television pictures, with each antenna element being capable of receiving signals of around 12 GHz.

Recently, several types of planar antennas have been proposed for DBS reception. Some of the modern systems are printed-circuit and microstrip antenna systems, utilizing an array of antenna elements radiating circularly or linearly polarized waves, and sometimes having one or more waveguides. The major problems in designing a planar phased array antenna system for satellite communication are high manufacturing cost, high insertion loss of the combining network, and the difficulty in providing dual polarization performance with good isolation between the two polarization ports. The major costs of manufacturing a conventional printed phased array antenna system are the cost of microwave substrate materials and the cost of the etching process. Moreover, in presently used systems, even when using the best existing microwave substrate material, the printed array combining network insertion loss is still very high for the high gain satellite antenna.

Several published articles address the problems faced by a team of Japanese engineers in designing and redesigning their models of high efficiency flat antennas, using a multi-level, parallel plate, radial line and slot antenna concept. These models are described in the following articles: IEEE, Antennas and Propagation Society International Symposium 1993, Vol. 3, Jun. 28 through Jul. 2, 1993; IEEE, Antennas and Propagation Society International Symposium 1994, Vol. 2, Jun. 19 through 24, 1994; IEEE, Antennas and Propagation Society International Symposium 1994, Vol. 3, Jun. 19 through 24, 1994; and IEEE, Antennas and Propagation Society International Symposium 1995, Vol. 4, Jun. 18 through 23, 1994. The major drawbacks to this team's approach are the high cost of manufacturing a multi-level parallel plate system and the degraded performance of the system with reduced aperture size. In this approach, when the diameter of the aperture is reduced to less than 18 inches, the reflections from the end of the parallel plate radial line slot antenna degrade the antenna performance significantly, due to the great amount of energy left toward the end of the antenna. Further, as noted in these articles, at least two levels of parallel plates are required to achieve the dual polarization performance.

Although helpful, prior advances in the design of the phased array antenna systems are still unable to cover today's needs. The manufacturing cost for a system with dual parallel plates is high. It becomes prohibitive for multi-level, dual polarization flat antenna systems, some of which are described in Handbook of Microstrip Antennas, Vol. 2, 1989. According to this handbook, more than nine layers of printed circuits are required to achieve the dual polarization performance requirement. Moreover, in multi-level systems, the path length of the transmission line from the input port of the antenna array to each array element is very long, triggering high insertion loss of the array feed and high system noise.

The high ratio of the antenna gain over the noise temperature is another important requirement for a good receiving antenna system. The antenna aperture size, aperture efficiency and the loss of the array feed are the major factors used to determine the antenna gain. The low side lobe radiation pattern and the low resistive insertion loss of an antenna are the keys for achieving a low noise temperature of the antenna. However, there is a trade off between the low side lobe radiation pattern and the aperture efficiency. The lower the side lobe of the antenna is, the lower the noise temperature and the aperture efficiency will be. Therefore, achieving the lowest loss in the array feed circuitry design, especially the lowest resistive insertion loss, is the ultimate goal for all phased array antenna designers. Good isolation requirements can be achieved by designing antennas with a low cross polarization level relative to the co-polarization level and with good design of the associated circuitry between the two polarization ports.

Some modern planar phased array antenna systems use waveguides because they have the lowest insertion loss among all guided wave circuitry. Moreover, waveguides have the highest power handling capabilities, but they are expensive to build. All prior art antenna systems complying with the dual polarization requirement use at least two levels of the waveguide network, thus drastically increasing the manufacturing cost.

Other modern planar phased array antenna systems use air-striplines because they have the second lowest insertion loss and a good power handling performance, as well as a relatively low manufacturing cost.

There is a need for a high performance, phased array antenna system for receiving satellite communication signals, having a high ratio of the antenna gain over the noise temperature, low insertion loss of the combining network, a dual polarization performance with good isolation between the two polarization ports, and a low manufacturing cost.

SUMMARY OF THE INVENTION

The preceding and other shortcomings of prior art systems are addressed and overcome by various aspects of the present invention, which consists of an array of antenna elements and a hybrid beam-combining network system utilizing both the waveguide concept and the air-stripline feed network with good isolation.

Accordingly, it is the purpose of this invention to provide a small, portable, inexpensive, lightweight planar phased array antenna system for the reception of Direct Broadcast Satellite signals.

Another purpose of the invention is to provide a high performance, phased array antenna system, having a high ratio of the antenna gain over the noise temperature and a low manufacturing cost.

It is a more specific purpose of the invention to provide a phased array antenna system that has high efficiency and excellent cross polarization performance over a wide frequency bandwidth. In an exemplary embodiment, this is achieved by utilizing a single layer (but possibly double sided) printed circuit dual polarization array aperture system including an air-stripline feed network having a low insertion loss and individual dual polarization antenna elements providing a low level of cross polarization between the respective feed network circuits associated with each of the two polarizations, in combination with a single level waveguide combining network which uses irises and/or wedges to optimize the impedance match and to achieve proper power division.

The preferred embodiment of the present invention is a phased array antenna system with a top layer that is transparent to the radiation of interest (preferably in the form of a perforated plate or solid plate made of very low loss plastic material), and that provides mechanical support and protection to the individual components, a middle layer functioning as an antenna aperture layer (preferably in the form of a single layer printed circuit board on which is formed an array of antenna elements and plurality of stripline feed network circuits, each combining in-phase outputs from several adjacent antenna elements), and a bottom layer functioning as the ground plane for the antenna aperture layer and also including a single level waveguide combining network for combining in-phase outputs from stripline feed network circuits, electromagnetically coupled to respective transition probe holes of the waveguide combining network.

Each antenna element is preferably a dual polarization octagonal patch antenna element disposed on a common surface of the antenna aperture layer. Each feed network circuit is preferably in a form of an air-stripline feed network circuit separated by a layer of air dielectric from the ground plane and preferably is on the same surface of the antenna aperture layer as the antenna elements.

Each feed network circuit belongs to either a horizontal (or right hand circular) polarization feeding subnetwork or to a vertical (or left hand circular) polarization feed subnetwork. Each feeding subnetwork is designed as a parallel-series feed network scheme having several parallel feed network columns, and may be used to receive orthogonally polarized waves from the antenna elements. Each feed network column combines outputs of the same polarization from one or more (preferably two) adjacent columns of the array of antenna elements. Each feeding subnetwork has several (e.g. eight) feed network columns, each having a plurality of serial feeder lines, and each serial feeder line has a plurality of parallel feeder lines. Each parallel feeder line combines in-phase outputs of same polarization from several (typically four) adjacent equidistant antenna elements. Each antenna element has two feeds, one from each feed network column of the respective polarization.

The single level waveguide combining network is preferably an integral structure including a horizontal (or right hand circular) polarization waveguide section, a vertical (or left hand circular) polarization waveguide section, a horizontal (or right hand circular) polarization port, and a vertical (or left hand circular) polarization port. The dual orthogonal polarization waveguide sections lay in the same plane and preferably are asymmetrically disposed on either side of a common wall, with each containing a branched cavity symmetrically disposed about a respective centerline. In an exemplary embodiment, each orthogonal polarization waveguide section has a primary tee-junction, two secondary tee-junctions and four tertiary tee-junctions, two primary ninety degree bends coupling the primary tee-junction to a respective one of the two secondary tee-junctions, and four secondary ninety degree bends coupling each secondary tee-junction to a respective one of the four tertiary tee-junctions. Each tertiary tee-junction is provided with two transition probe holes, whereby received microwave signals are supplied from eight similarly polarized feed network circuits to eight respective transition probe holes of the waveguide combining network via pin probes that extend from each of the feed network circuits through input nodes in the ground plane to the interior of the waveguide.

The foregoing and additional features and advantages of this invention will become further apparent from the detailed description and accompanying drawing figures that follow. In the figures and written description, numerals indicate the various features of the invention, like numerals referring to like features throughout the drawing figures and the written description.

DETAILED DESCRIPTION OF THE INVENTION

This invention relates to a small, portable, inexpensive, lightweight planar phased array of antenna elements usable for receiving dual polarization Direct Broadcast Satellite signals. The system has a hybrid beam-combining network, preferably utilizing a printed air-stripline feed network and a single level waveguide combining network.

Figure 1:
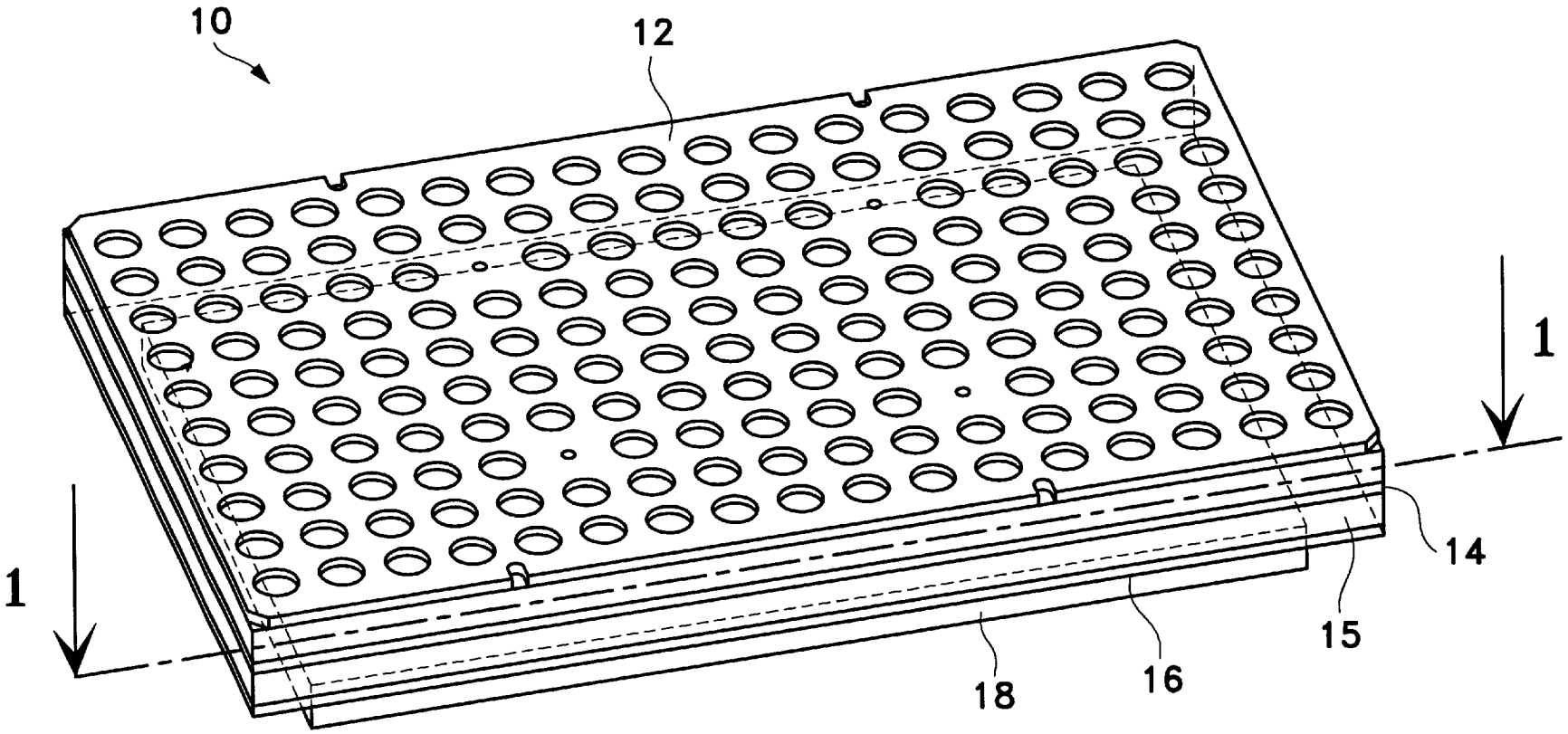
FIG. 1 is an illustration of a perspective view of a preferred embodiment of the phased array antenna system of the preferred embodiment of a present invention, including a top layer in the form of a perforated plate, a middle antenna aperture layer in the form of a single layer printed circuit board with an array of antenna elements and plurality of stripline feed network circuits, a bottom layer functioning as the ground plane for the antenna aperture layer and a single level waveguide combining network.

In accordance with the preferred embodiment of the present invention, FIG. 1 presents an illustration of a perspective view of a phased array antenna system. As shown in FIG. 1, a phased array antenna system 10 of the present invention includes a window layer in the form of a perforated plate 12, an antenna aperture layer 14, in the form of a single layer printed circuit board possibly double sided, with an array of antenna elements 20 and plurality of stripline feed network circuits 22 forming the feed network, a ground plane layer 16 for the antenna aperture layer 14, and a single level waveguide combining network 18 placed underneath the ground plane layer 16, all arranged and integrated in a compact rectangular package. The perforated plate 12 can be made of metal, preferably aluminum, plastic or any other material known in the art. (Note that the perforated plate 12 can be replaced by a solid plate made of very low loss plastic material.) The ground plane layer 16 and the waveguide combining network 18 are made of metal, preferably aluminum or other metal having good conductivity, and the waveguide combining network 18 is screwed to, welded to, or integrally cast with the ground plane 16.

Figure 2:
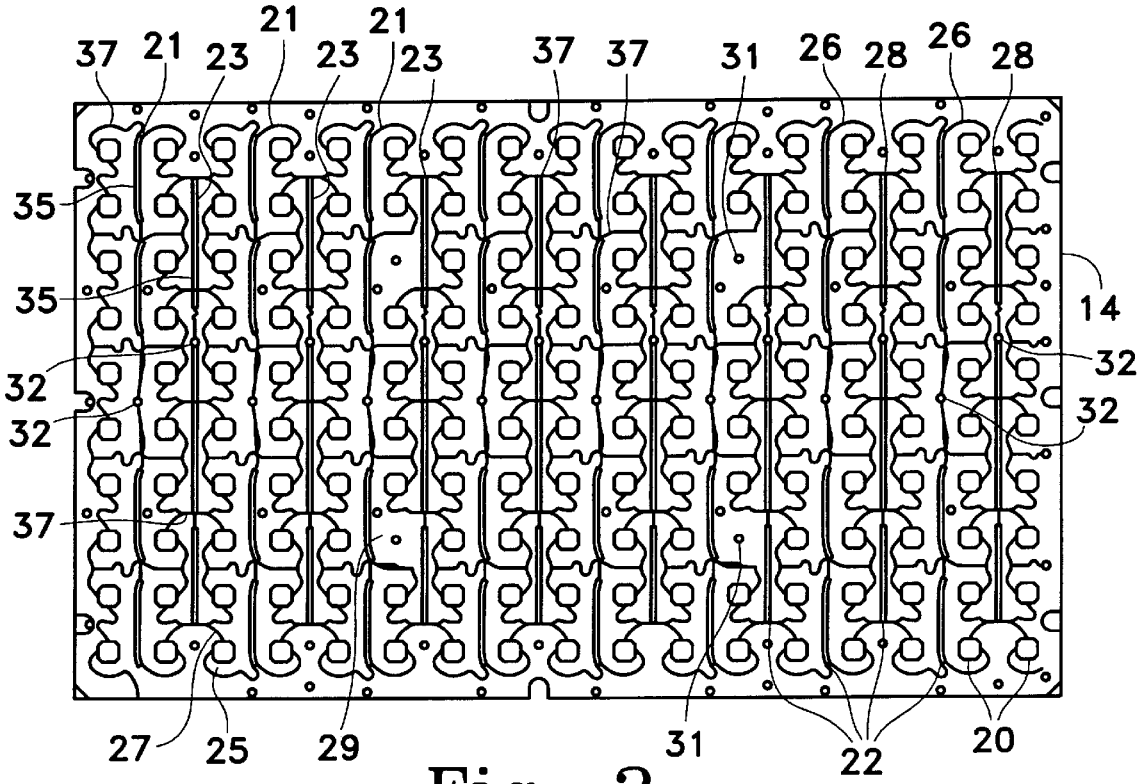
FIG. 2 is a top view of the single layer printed circuit board consisting of an array of printed octagonal patch antenna elements and a plurality of stripline feed network circuits.

FIG. 2 is a top view of the single layer printed circuit board 14. In accordance with the preferred embodiment of the present invention, each antenna element 20 of the array of antenna elements 20 is preferably a dual polarization antenna element 20, disposed on a common surface of the antenna aperture layer 14, also having a plurality of stripline feed network circuits 22, each combining in-phase outputs from several adjacent antenna elements 20. The antenna aperture layer 14 consists of an array 20 of printed antenna elements 20. There are seventeen antenna elements 20 in almost each row, and ten antenna elements 20 in almost each column of the antenna aperture layer 14, although it should be understood that there can be less or more elements, which may be placed in different configurations. Several antenna elements 20 are omitted, in order to provide space for spacer locations 29.

Figure 3:
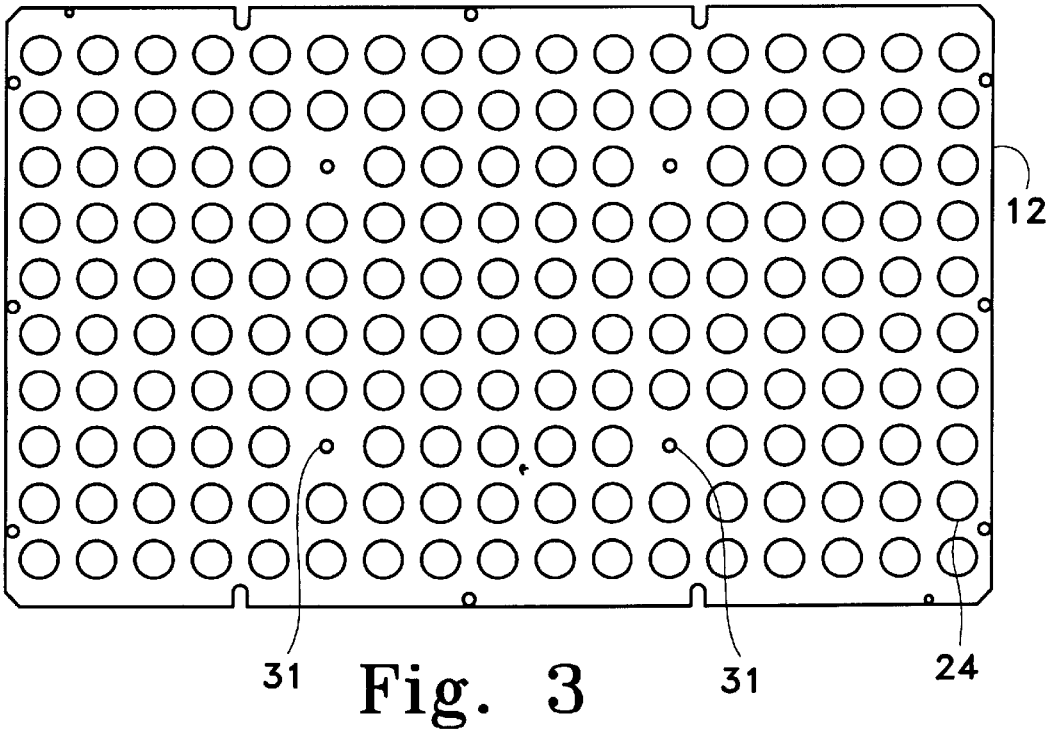
FIG. 3 is a top view of the perforated plate.

The perforated plate 12 is transparent to the radiation and each antenna element 20 is located right underneath one of open circular holes 24 of the perforated plate 12 shown in FIG. 3. The perforated plate 12 and the ground plane 16 are used to support the feed network circuits 22 and to enhance the support of the phased array antenna system 10.

In an alternate embodiment (not shown) the antenna system 10 may be encompassed in a cover, not shown, which includes a radome and a polystyrene foam layer. The polystyrene foam layer is used in order to provide support for the antenna elements 20 and to minimize the risk of damage. The polystyrene foam is a material of very low dielectric constant and low radio frequency loss, and its presence has an insignificant effect on the signal reception performance of the phased array antenna system 10. The radome is preferably made of water-repellant plastic material, e.g., ABS resin, to prevent water absorption.

The antenna aperture layer 14 is particularly suited for receiving signals of the format intended for use by conventional DBS networks. Each feed network circuit 22 is preferably in a form of an air-stripline feed network circuit 22 (see FIG. 2), separated by a layer of air dielectric 15 (see FIG. 1) from the ground plane 16, in order to reduce the insertion loss, and preferably is on the same surface of the antenna aperture layer 14 as the antenna elements 20. Each feed network circuit 22 in the preferred embodiment of the present invention belongs to one of the two separate orthogonal polarization feeding subnetworks, a horizontal polarization feeding subnetwork 21 or a vertical polarization feeding subnetwork 23, and they receive orthogonally polarized waves from the antenna elements 20. Although the depicted example utilizes horizontal and vertical polarization, it should be understood to those skilled in the art the two orthogonal polarizations could be right-hand circular polarization and left-hand circular polarization, for example by combining the horizontally and vertically polarized outputs from the antenna elements 20 with relative phase shifts of ±90°.

The horizontal polarization feeding subnetwork 21 is designed as a parallel-series feed network scheme, as shown in FIG. 2, having several parallel horizontal polarization feed network columns 26. The same design is applied to the vertical polarization feeding subnetwork 23, having several parallel vertical polarization feed network columns 28, and connected to the same antenna elements 20, but with signals of the orthogonal polarization. Therefore, in the preferred embodiment of the present invention, almost all of the antenna elements 20 have two feeds, one from each feed network column 26 and 28, of the respective polarization.

Each feed network column 26 and 28 combines outputs of the same polarization from two adjacent columns of the array of antenna elements 20. As shown in FIG. 2, the vertical polarization feed network columns 28 and the horizontal polarization feed network columns 26 alternate with each other. In-phase outputs from feed network columns 26 and 28 are electromagnetically coupled to the waveguide combining network 18.

Each feeding subnetwork 21 and 23 has eight feed network columns 26 and 28, and each feed network column 26 and 28 is designed as a parallel-series feed network scheme, having a plurality of serial feeder lines 35, and each serial feeder line 35 has a plurality of parallel feeder lines 37, as shown in FIG. 2. Each parallel feeder line 37 combines in-phase outputs of same polarization from several adjacent equidistant antenna elements 20, from at least two and mostly four respective adjacent antenna elements 20. Some parallel feeder lines 37 placed at the edges of the antenna aperture layer 14 combine in-phase outputs of same polarization from only two adjacent equidistant antenna elements 20, which makes the phased array antenna system 10 asymmetrical, but simplifies the construction of the preferred embodiment of the present invention. Feedlines of the feed network circuits 22, consisting of the feed network columns 26 and 28, serial feeder lines 35 and parallel feeder lines 37, have generally transverse cross-sections of varying line width and different lengths, in order to provide impedance matching within each feed network column 26 and 28.

The feed network columns 26 and 28, serial feeder lines 35 and parallel feeder lines 37 are short, in order to decrease the insertion loss and to increase frequency bandwidth of the phased array antenna system 10. In the preferred embodiment of the invention, in order to reduce the insertion loss to the minimum, the horizontal polarization feeding subnetwork 21 and the vertical polarization feeding subnetwork 23 are interleaved in the printed circuit antenna aperture layer 14. The feed network columns 26 and 28 may be printed on a film substrate or etched on the printed circuit antenna aperture layer 14. The printed circuit antenna aperture layer 14 is thus supported on a rectangular dielectric base plate preferably in the form of a copper-plated printed circuit board.

Figure 4:
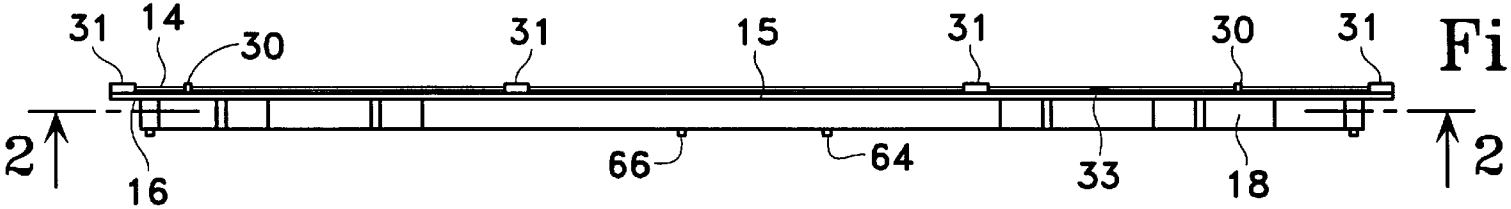
FIG. 4 is a cross-sectional view of the array of antenna elements, taken along line 1—1 of FIG. 1, including the antenna aperture layer, the ground plane, the single level waveguide combining network, and several levels of spacers and bosses.

FIG. 4 is a cross-sectional view of the phased array antenna system 10, showing the printed circuit antenna aperture layer 14, the ground plane 16, the single level waveguide combining network 18, a bottom plate 19 (FIG. 6) and several levels of guide pins 30, spacers 33 and bosses 31, in accordance with a preferred embodiment of the present invention. The perforated plate 12 is supported by a plurality of bosses 31, presented in FIGS. 3 and 4. The bosses 31 penetrate through the printed circuit antenna aperture layer 14 as indicated in FIG. 2, and which is drilled in the boss locations 29, and is made clear of antenna elements 20 in order to provide space for the bosses 31. The printed circuit antenna aperture layer 14 is supported by several spacers 33 placed on the ground plane 16, as shown in FIG. 4. The spacers 33 of the preferred embodiment of the present invention define an air dielectric 15 layer between the feeder lines 22 and the ground plane 16, which serves to reduce insertion loss. The spacers 33 should have uniform dimensions and be accurately spaced, according to the layer in question and the required performance. These spacers 31 are preferably integrally cast with the waveguide 18 and ground plane 16.

Figure 6:
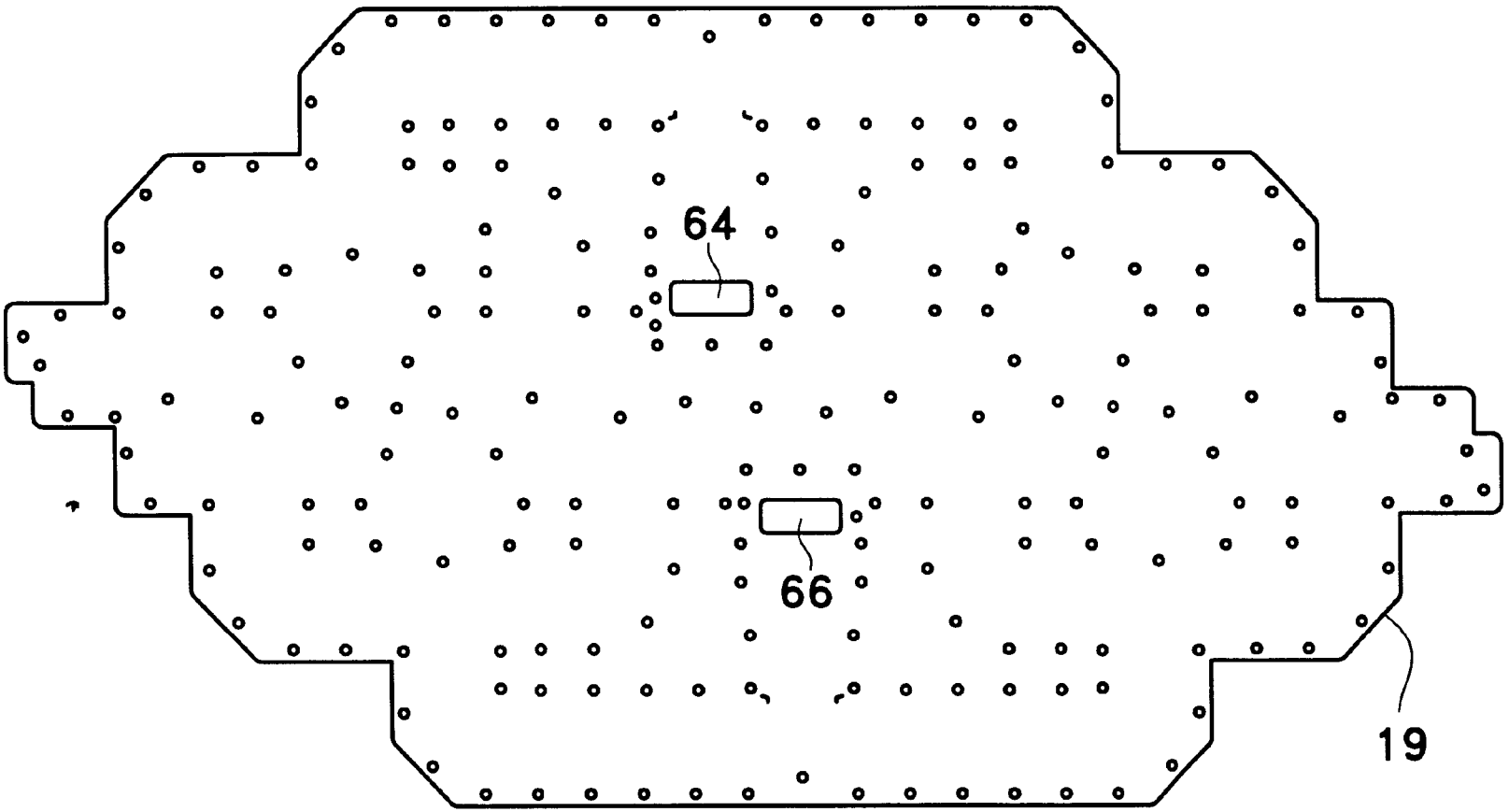
FIG. 6 is a bottom view of the single level waveguide combining network showing dual orthogonal polarization ports.

Signals received from the antenna elements 20 are coupled through the antenna waveguide combining network 18 to the vertical and horizontal polarization ports 64 and 66 respectively, extending downwardly through the bottom plate 19 of the waveguide combining network 18, shown in FIG. 6, and interfaced with an external RF electronics module, not shown, attached to the vertical polarization port 64 and the horizontal polarization port 66, through which the received signals are combined and passed to the receiver, not shown. The horizontal polarization port 66 is coupled to the horizontal polarization feeding subnetwork 21 and the vertical polarization port 64 is coupled to the vertical polarization feeding subnetwork 23 and two ports, vertical polarization port 64 and horizontal polarization port 66, are decoupled, as preferred. The array of antenna elements 20 is generally symmetrical and the phased array antenna system 10 benefits from the symmetrical radiation of the phased array antenna system 10 for each of the polarization ports 64 and 66.

Figure 7A:
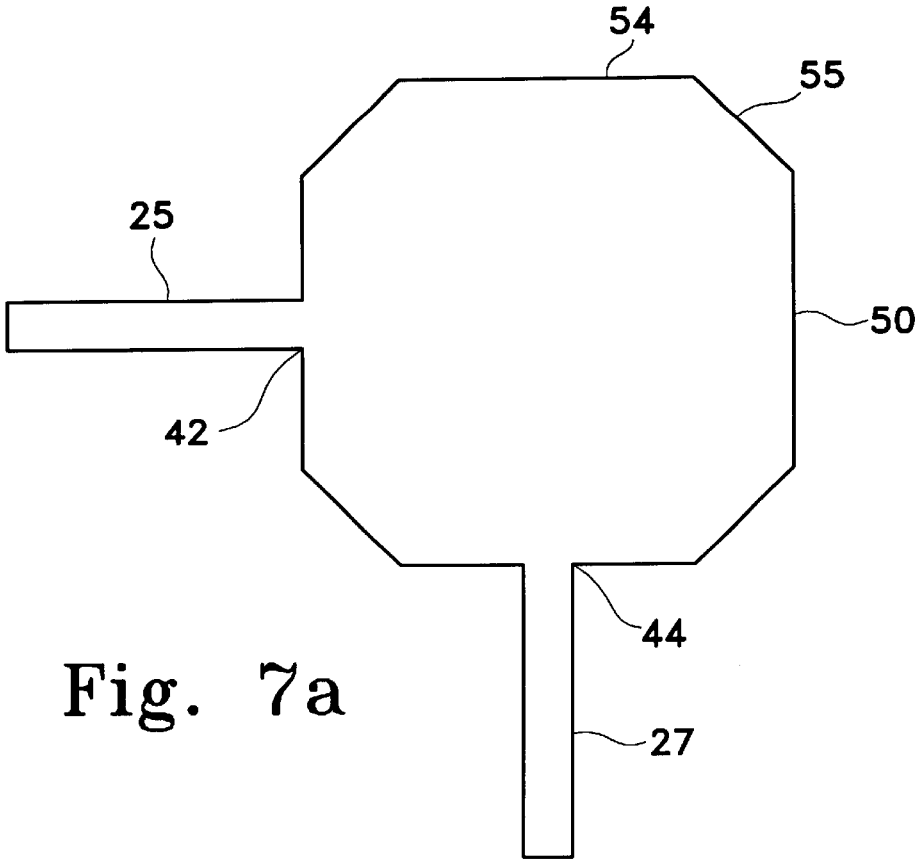
FIG. 7A is a top view of an antenna element designed as an octagonal patch printed in the same layer with the stripline feed network.
Figure 7B:
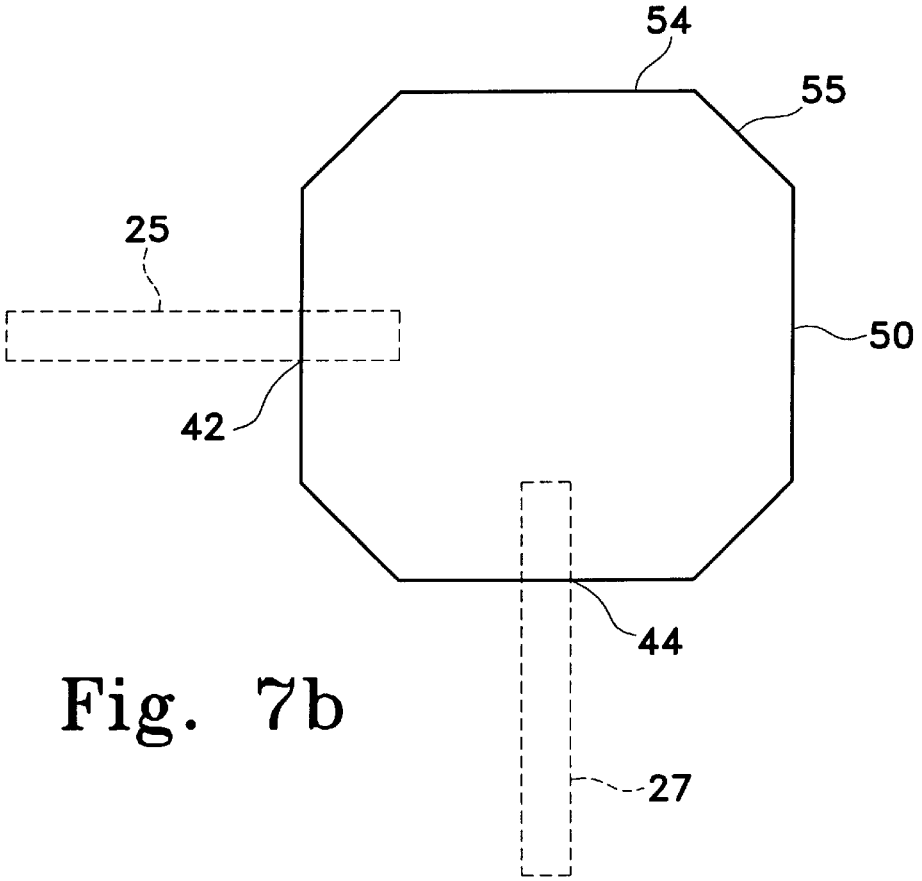
FIG. 7B is a top view of an antenna element designed as an octagonal patch with a stripline feed network printed underneath the patch, in accordance with another preferred embodiment of the present invention.

In the preferred embodiment of the present invention, each antenna element is preferably disposed on a common surface of the antenna aperture layer 14, and designed as a dual polarization octagonal patch antenna element 50, as shown in FIGS. 7*a* and 7*b*, but it can have other shapes as well. Each dual polarization octagonal patch antenna element 50 feeds a respective feed network columns 26 and 28 at two orthogonal positions, thus generating two spatially orthogonal linear polarized waves, of vertical and horizontal polarization, which are independent of each other. Thus, individual dual polarization octagonal patch antenna elements 50 provide a low level of cross polarization between the respective feed network circuits 22 associated with each of the two polarizations.

Each octagonal patch antenna element 50 feeds respective cross polarization feeder lines 37, through a horizontal polarization feed 25 and a vertical polarization feed 27 connected to the octagonal patch antenna element 50 at two orthogonal positions, a horizontal feed point 42 and a vertical feed point 44. Thus, each octagonal patch antenna element 50 has two feed points 42 and 44, formed integrally with the octagonal patch antenna element 50, and at its two feed points 42 and 44 feeds the feed network columns 26 and 28 with propagated microwave energy.

In one preferred embodiment of the present invention, the horizontal feed 25 and the vertical feed 27 of these dual polarization octagonal patch antenna elements 50 are printed in the same layer with the octagonal patch antenna elements 50, as presented in FIG. 7A. In another preferred embodiment of the present invention, they are printed in a separate layer, underneath the printed circuit antenna aperture layer 14, and are electromagnetically coupled to the octagonal patch antenna elements 50, as shown in FIG. 7B.

The octagonal patch antenna element 50 can be formed from a square patch, by cutting out the four corners, thus creating eight alternating sides, four a-sides 54 and four b-sides 55, placed between respective a-sides. In the preferred embodiments as presented in FIGS. 7A and 7B, the lengths of the a-sides 54 and the b-sides 55 of each octagonal patch antenna element 50 are not the same and need to be experimentally determined and optimized, in order to achieve the required isolation and cross polarization performance. The conventional square patch antenna elements have relatively poor isolation and cross polarization performance. The octagonal patch antenna elements 50, as presented in this invention, have low level of cross polarization between the respective feed network circuits associated with each of the two polarizations and an improvement in isolation of over 20 dB.

Figure 9A:
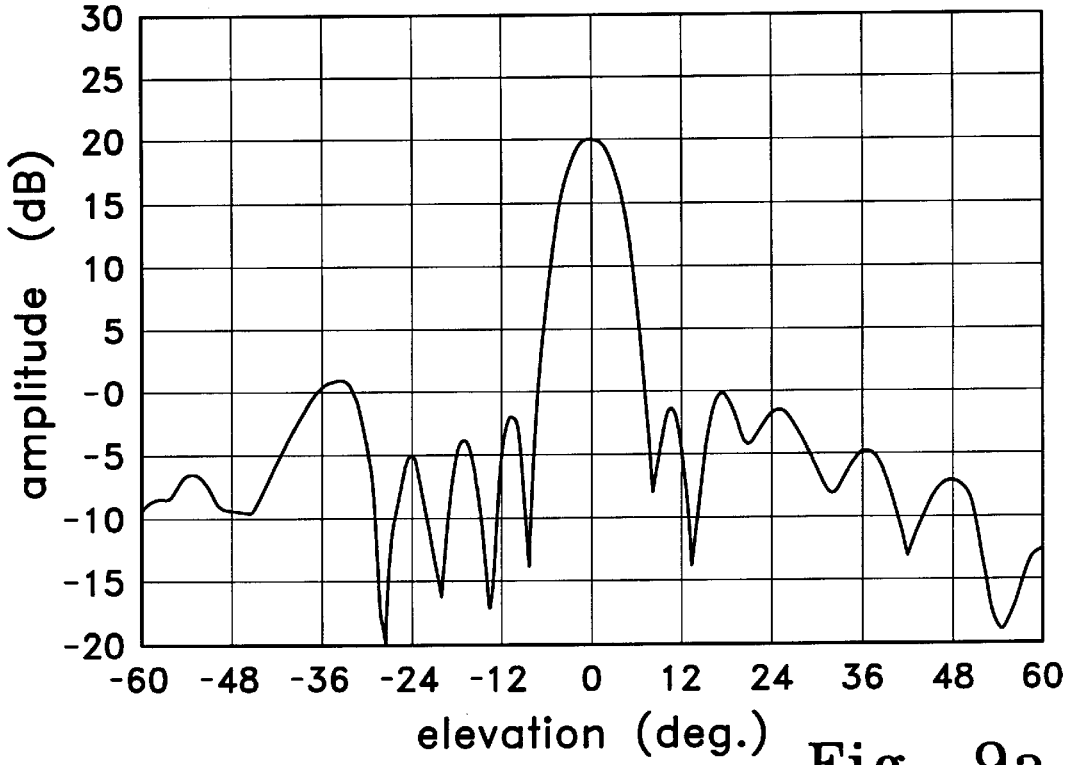
FIG. 9A is a diagram indicating a co-polarization pattern of an array of twenty antenna elements, placed in two columns and ten rows.
Figure 9B:
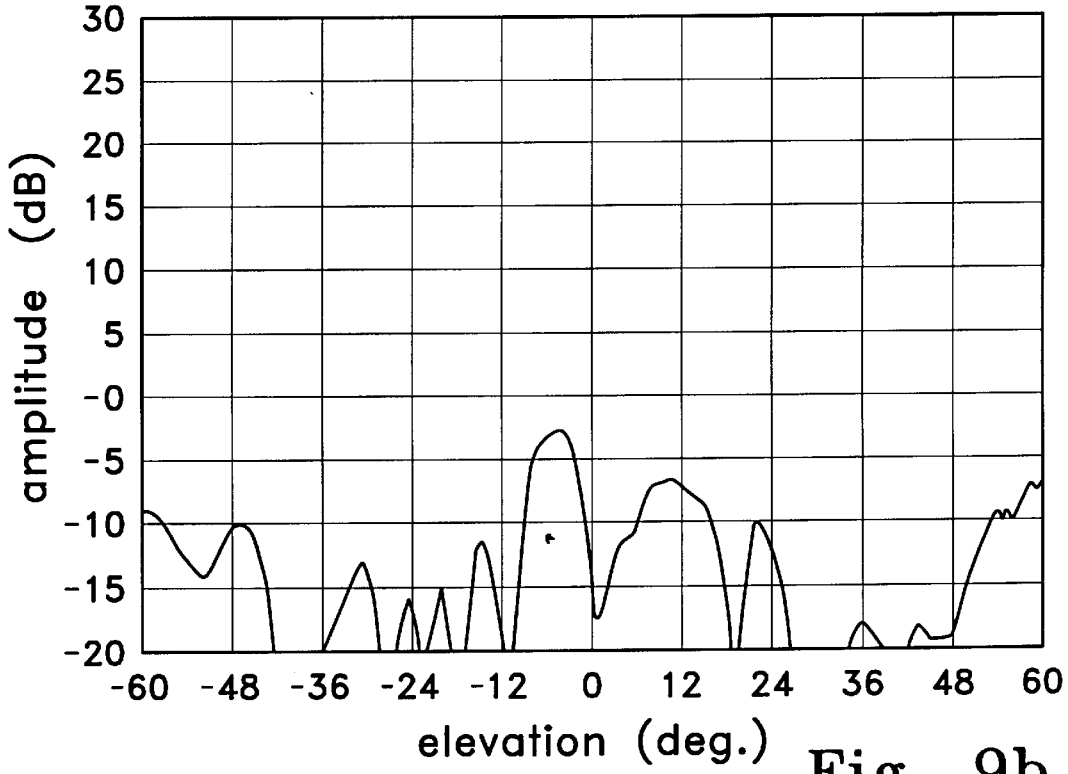
FIG. 9B is a diagram indicating a cross polarization pattern of an array of twenty antenna elements, placed in two columns and ten rows.

FIGS. 9A and 9B illustrate the measured radiation patterns of an array of twenty antenna elements, placed in two columns and ten rows, made according to the preferred embodiment of the present invention as octagonal patch antenna elements 50. FIG. 9A is a diagram showing an exemplary co-polarization radiation pattern of the array. FIG. 9B is a similar diagram showing that the cross polarization level of the array is low in comparison with the co-polarization level presented in FIG. 9A. In this experiment, an antenna array efficiency better than 75% and excellent cross polarization performance was obtained.

The single level waveguide combining network 18 combines in-phase outputs from several stripline feed network circuits 22, electromagnetically coupled to the waveguide combining network 18 via respective transition probe holes 40. FIGS. 2 and 4 illustrate pin probes 30 used for electromagnetic coupling of energy from the printed circuit antenna aperture layer 14 and the feed network circuit 22 to the waveguide combining network 18. The pin probes 30 are placed inside corresponding holes 32 in the printed circuit antenna aperture layer 14, input nodes, not shown, in the ground plane 16, and the transition probe holes 40 in the waveguide combining network 18, as shown in FIG. 5 taken along line 2—2 of FIG. 4, and are connected to the feed network circuits 22.

In the preferred embodiment of the present invention there are sixteen transition probe holes 40, drilled thru the die casting parts, and a corresponding number of pin probes 30 are soldered or welded to the corresponding feed lines 22 of the antenna aperture layer 14. It should be understood that there could be less or more transition probe holes. Length of the pin probes 30, their distance from the back 79 of the waveguide wall and the diameter of the transition probe holes 40 are the parameters manipulated in order to optimize the impedance match of the phased array antenna system 10. The pin probes 30 provide a compact transition between electromagnetic feedlines such as the feed network circuit 22 of the present invention and free space inside the cavities of the waveguide combining network 18, acting as a transformer. Alternatively, rectangular coupling slots, not shown, created within the octagonal patch antenna elements 50, could probably be used instead of the pin probes 30, and might provide easier manufacturing and reduced final assembly cost.

Figure 5:
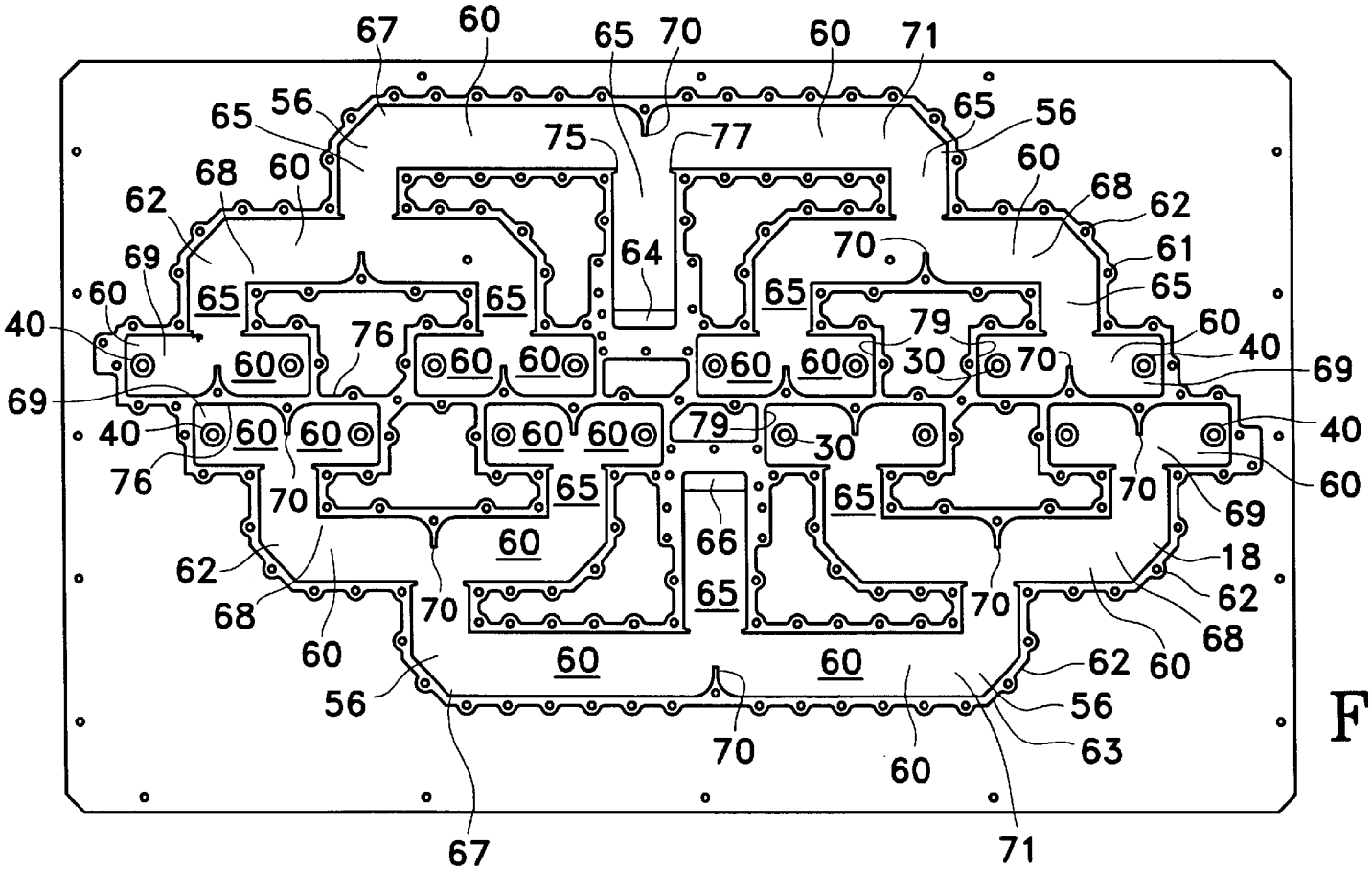
FIG. 5 is a cross-sectional view, taken along line 2—2 of FIG. 4, of the single level waveguide combining network with three cascaded sets of tee-junctions and two sets of ninety degree bends in each waveguide subsystem, where each tee-junction utilizes three irises to optimize the power division performance.

As shown in FIG. 5, the waveguide combining network 18 is preferably designed as a single level architecture, in order to improve performance and cut down the manufacturing cost. It serves as a beam forming part used for combining the reception of microwave signals, thus reducing the insertion loss of the phased array antenna system 10 and increasing its gain.

The single level waveguide combining network 18 is preferably an integral structure including a horizontal polarization waveguide section 63, a vertical polarization waveguide section 61, a vertical polarization port 64, and a horizontal polarization port 66. The horizontal and vertical polarization waveguide sections 63 and 61 lay in the same plane and preferably are asymmetrically disposed on either side of a common wall 76, with each containing a branched cavity 71 symmetrically disposed about a respective centerline, three cascaded subsections of tee-junctions 60 and two cascaded subsections of ninety degree bends 56 and 62, providing right angle transition, although it is possible to have other combinations as well. The antenna waveguide combining network 18 of preferred embodiment of the present invention is designed as a planar metallic chassis, preferably die-cast of aluminum, although it could be made of different shape and material as well.

In an exemplary embodiment, each horizontal and vertical polarization waveguide section 61 and 63 has a primary tee-junction 67, two secondary tee-junctions 68 and four tertiary tee-junctions 69, two primary ninety degree bends 56 coupling the primary tee-junction 67 to a respective one of the two secondary tee-junctions 68, and four secondary ninety degree bends 62 coupling each secondary tee-junction 68 to a respective one of the four tertiary tee-junctions 69. Each tertiary tee-junction 69 is provided with two transition probe holes 40, whereby received microwave signals are supplied from eight similarly polarized feed network circuits 22 to eight respective transition probe holes 40 of the waveguide combining network 18 via pin probes 30 that extend from each of the feed network circuits 22 through input nodes, not shown, in the ground plane 16, to the interior of the waveguide combining network 18.

Each tertiary tee-junction 69 is coupled to a respective one of the secondary tee-junctions 68 through the ninety degree bend 62, so that signals from the antenna elements 20 received through the transition probe holes 40 in each of the tertiary tee-junction 69 are combined at the respective secondary tee-junctions 68. The outputs from the secondary tee-junctions 68 are coupled to the respective primary tee-junction 67 and output through the polarization ports 64 and 66.

Figure 8A:
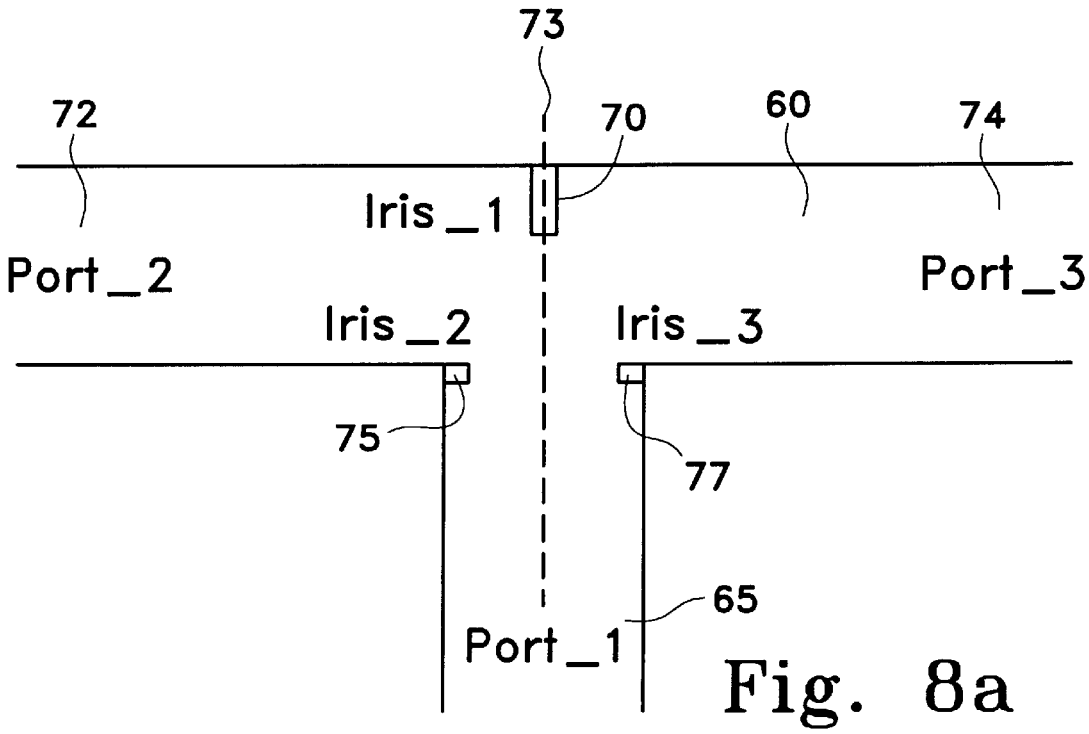
FIG. 8A is an illustration of a cross-sectional view of a tee-junction of the waveguide combining network incorporating a waveguide electromagnetic tuning concept utilizing irises to optimize the tee-junction performance; in accordance with another preferred embodiment of the present invention.
Figure 8B:
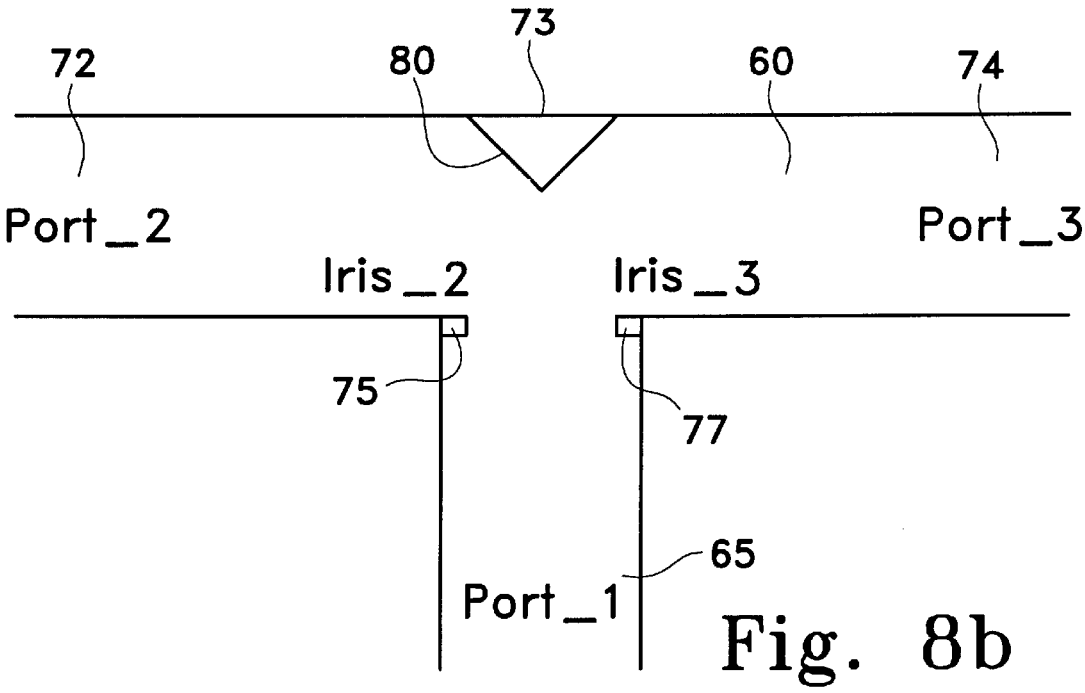
FIG. 8B is an illustration of a cross-sectional view of a tee-junction of the waveguide combining network incorporating a waveguide electromagnetic tuning concept utilizing a wedge and two irises to optimize the tee-junction performance, in accordance with another preferred embodiment of the present invention.

An impedance matching system is provided within the waveguide combining network 18 of the present invention, as illustrated in FIGS. 8*a* and 8*b*. It consists of electromagnetic deflectors shaped as irises 70, 75 and 77, and wedges 80, spaced periodically along the waveguide cavities 71. The irises 70, 75 and 77, and wedges 80 serve to provide impedance matching for the primary tee-junction 67 as well as for the secondary tee-junction 68 and the tertiary tee-junction 69, obtaining the desired power division ratios and greatly reducing the reflecting microwave energy at the junctions between the center (single input or combined output) waveguide section 65 and the two outer (split outputs or dual inputs) waveguide sections 60.

FIG. 8A is an illustration of a cross-sectional view of a tee-junction of the waveguide combining network 18 presenting the waveguide electromagnetic matching concept utilizing irises 70, 75 and 77 to optimize the tee-junction performance, in accordance with the preferred embodiment of the present invention. FIG. 8B is an illustration of a cross-sectional view of a tee-junction of the waveguide combining network 18, presenting the waveguide electromagnetic matching concept utilizing a wedge 80 and two irises 75 and 77 to optimize the tee-junction performance, in accordance with another preferred embodiment of the present invention.

FIG. 8A shows simple irises 70, 75 and 77 preferably used in each entrance port 65, 72 or 74 of the tee-junctions 67, 68 or 69 of the waveguide combining network 18. Position and length of the irises 70, 75 and 77 are experimentally chosen and used to fine tune the phased array antenna system 10 to a required impedance match. For example, in FIG. 8A, the location of the iris-1 70 is used to adjust the power between the port-2 72 and port-3 74. In the equal power division case, the iris-1 70 is located in the centerline 73 of the port-1 65 cavity. As the iris-1 70 gets moved toward the direction of the port-2 72, more power is transmitted to the port-3 74 from the input port-1 65. Iris-2 75 and iris-3 77 are used to further fine tune the impedance match at the tee-junction between the input-port-1 65 and the port-2 72 as well as between the input-port 1 65 and the port 3 74.

FIG. 8B shows a wedge 80, shaped as a pyramid, used to replace the iris-1 70 shown in FIG. 8A. The impedance match is improved by adjusting the size of the base of the wedge 80 and the angle between its sides and the base. Similarly to the approach shown in FIG. 8A, the location of the wedge 80 is experimentally determined in order to obtain the desired power division of the waveguide combining network 18.

Figure 10A:
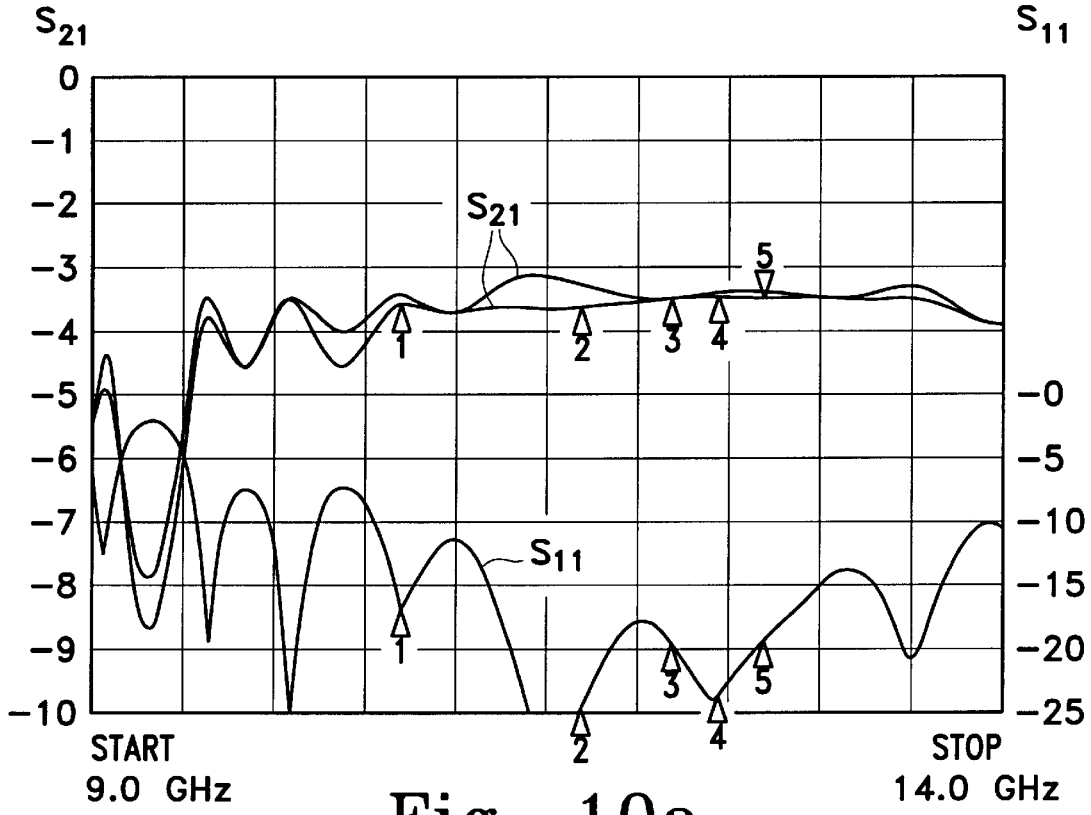
FIG. 10A is a diagram representing the performance of a waveguide tee-junction with an equal power division.
Figure 10B:
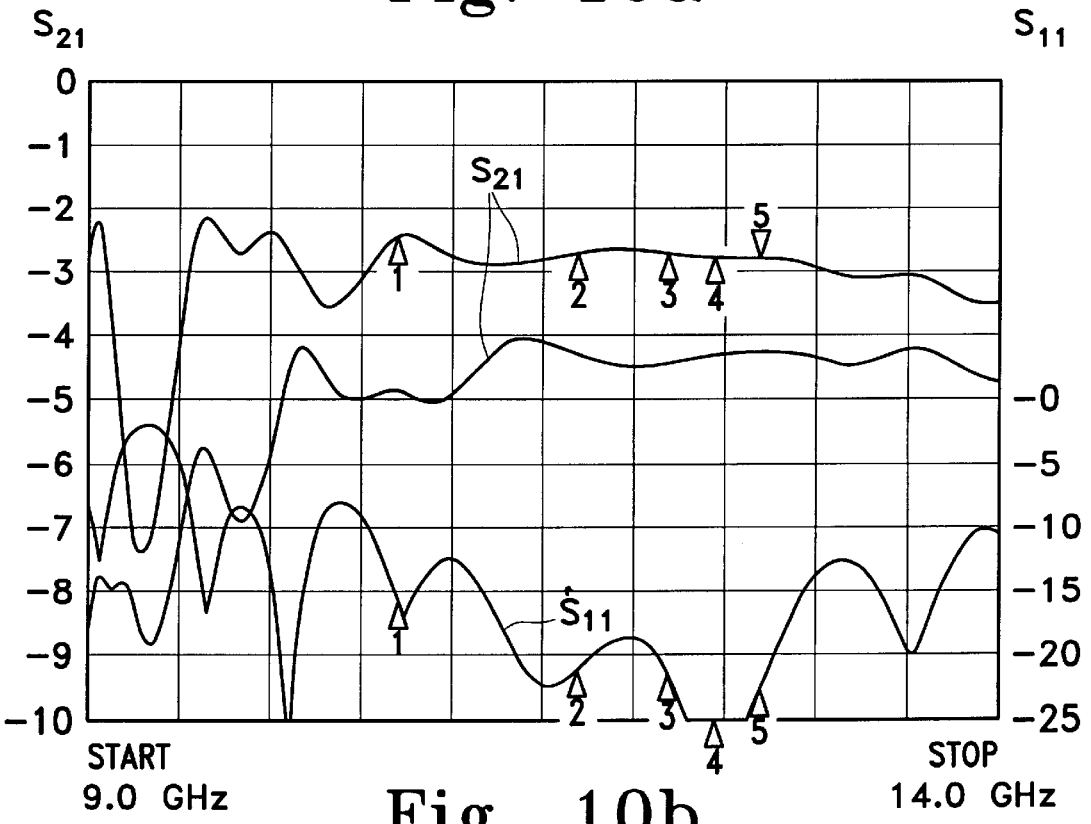
FIG. 10B is a diagram representing the performance of a waveguide tee-junction with an unequal power division.

Based on the presented waveguide concept of the present invention, as shown in FIG. 5, a single level waveguide combining network 18 with equal and unequal power division was developed and tested. The measured performances with equal and unequal waveguide power division are shown in FIGS. 10A and 10B, respectively. Almost equal power split over the interested frequency band (12.2 to 12.7 GHz) was achieved. In the unequal power division case, shown in FIG. 10B, iris 70, is moved away from the waveguide cavity centerline, to send more energy towards the ports 2 72 and less towards the port 3 74. Note that the measured data (FIG. 10A and 10B) include the losses from the SMA connectors transition to the waveguide. The lengths and the locations of the irises 70, 75 and 77 were determined empirically and optimized for each tee-junction 67, 68 and 69. In the example shown in FIG. 10B, the iris-1 70 was off 0.05 inches from the centerline of the input port-1 65 of the waveguide with the unequal power division. With the waveguide combining network 18 of the present invention, wherein the total path length of the transmission line from each vertical or horizontal polarization port 64 or 66 to the farthest transition probe hole 40 is only 10.92 inches, the measured insertion loss of less than 0.1 dB was achieved.

Uniform transition from the antenna aperture 14 to the waveguide combining network 18 is achieved through the optimal transition design such that all the electromagnetic field signal components received by the antenna elements 20 are uniformly passed to the tertiary tee-junction 69, and from there, to the secondary tee-junction 68 and the primary tee-junction 67, through the common cavity 71. Received microwave signal energy decreases progressively as the pin probes 30 get closer to the sides of the antenna aperture layer 14, and the termination loss at the periphery of the antenna aperture layer 14 is relatively small, which in turn provides low side lobe radiation pattern.

The phased array antenna system 10 described herein is a high performance phased array antenna system for satellite communication, having a high ratio of the antenna gain over the noise temperature, extremely low insertion loss of the beam-combining network, a dual polarization performance with good isolation between the two polarization ports, and can be built at a low manufacturing cost.

While this invention has been described with reference to its presently preferred embodiment(s), its scope is only limited insofar as defined by the following set of claims and all equivalents thereof.

What is claimed is:

1. A phased array antenna system comprising:

a two-dimensional array of antenna elements;

a first external waveguide port, and exactly two feed subsystem components for coupling said two-dimensional array to said external waveguide port:

a single level waveguide network component including a first hollow waveguide section having at least four internal waveguide ports, for electromagnetically coupling a common external feed signal at said first external waveguide port to a first plurality of internal feed signals, each at a respective one of said internal waveguide ports; and a single level dielectric substrate component supporting a first plurality of printed feed network circuits, each said printed feed network circuit electromagnetically coupling a respective one of said internal feed signals to the antenna elements in a respective subarray of said array.

2. The phased array antenna system of claim 1 wherein:

all said antenna elements and all said printed feed network circuits are disposed on said single dielectric substrate component.

3. The phased array antenna system claimed in claim 2 wherein:

each said feed network circuit is an air-stripline feed network separated by a layer of air dielectric from a ground plane.

4. The phased array antenna system claimed in claim 3 wherein:

each said feed network circuit is organized in the form of a column with a plurality of serial feeder lines and a plurality of parallel feeder lines.

5. The phased array antenna system claimed in claim 4 wherein:

said serial feeder lines and said parallel feeder lines each having generally a transverse cross-section of a respective predetermined size to optimize the impedance match of the printed feed network circuit.

6. The phased array antenna system claimed in claim 3 wherein:

an external surface of said waveguide network component functions as a ground plane for all said antenna elements, and each said internal feed signal is electromagnetically coupled through said external surface to a respective one of said printed feed network circuits.

7. The phased array antenna system claimed in claim 1 wherein:

said single level waveguide network component also includes a second hollow waveguide section for electromagnetically coupling a second external feed signal at a second external waveguide port to a second plurality of internal feed signals at a second plurality of internal waveguide ports;

the first and second external feed signals have respective polarizations that are mutually orthogonal; and said single level dielectric substrate component also includes a second plurality of printed feed network circuits each electromagnetically coupling a respective one of said second plurality of internal feed signals to a respective plurality of said antenna elements.

8. The phased array antenna system claimed in claim 7, wherein:

the first polarization is horizontal polarization and the second polarization is vertical polarization.

9. The phased array antenna system claimed in claim 7, wherein:

the first polarization is right-hand circular polarization and the second polarization is left-hand circular polarization.

10. The phased array antenna system claimed in claim 7 wherein:

each said antenna element is a dual polarization octagonal antenna element comprising a first set of four sides having a first predetermined length, and a second set of four sides having a second predetermined length different from said first predetermined length, and each side belonging to the second set of four sides is placed between the two sides belonging to the first set of four sides.

11. The phased array antenna system claimed in claim 10 wherein:

each said feed network circuit is on a same surface of said single level dielectric substrate and is formed integrally with said antenna elements.

12. The phased array antenna system claimed 10 wherein:

each said feed network circuit is on a same surface of said dielectric substrate component and is electromagnetically coupled through said dielectric substrate to its respective said antenna elements.

13. The phased array antenna system claimed in claim 7, wherein:

said single level waveguide network component is an integral structure comprising said first and second waveguide sections;

the second waveguide section is placed side-by side with said first waveguide section;

the first external port is located within said first waveguide section;

the second external port is located within said second waveguide section;

said first waveguide section and said second waveguide section are co-planar and asymmetrically disposed on either side of a common wall; and said first and second waveguide sections each contain a waveguide cavity symmetrically disposed about a respective centerline.

14. The phased array antenna system claimed in claim 7 wherein each said waveguide section comprises:

a primary tee-junction;

a plurality of secondary tee-junctions;

a plurality of tertiary tee-junctions;

a plurality of primary ninety degree bends, each said primary ninety degree bend coupling the primary tee-junction to a respective one of said secondary tee-junction; and a plurality of secondary ninety degree bends, each said secondary ninety degree bend coupling each said secondary tee-junction to a respective one of said tertiary tee-junction.

15. The phased array antenna system claimed in claim 14 wherein:

each said tertiary tee-junction is located at a respective one of the internal waveguide ports, each of said internal waveguide port comprises at least one transition probe hole formed through the dielectric substrate component and the tertiary tee-junction, and a respective pin probe couples each of the internal feed signals to a respective one of the internal waveguide ports, each said pin probe protruding through a respective said transition probe hole and being connected to the respective said feed network circuit, whereby any received microwave signals are supplied through said transition probe holes from the feed network circuit to the waveguide network component and any transmitted microwave signals are supplied through said transition probe holes to the feed network circuit from the waveguide network component.

16. The phased array antenna system claimed in claim 14 wherein:

each said waveguide section consists essentially of two secondary tee-junctions, four tertiary tee-junctions, two primary ninety degree bends and four secondary ninety degree bends.

17. The phased array antenna system claimed in claim 14 wherein:

an external surface of said waveguide network component functions as a ground plane for said antenna elements.

18. The phased array antenna system claimed in claim 7 wherein each said waveguide section further comprises:

a plurality of tee-junctions, each tee-junction having two branches extending from a single trunk, and a respective impedance matching system including at least one electromagnetic deflector associated with each said tee-junction, said deflectors being collectively sized and located to provide impedance matching and a predetermined power division with a minimal return termination loss.

19. The phased array antenna system claimed in claim 18 wherein each said impedance matching system further comprises:

a first deflector disposed between said two branches facing said trunk, a second deflector in the form of an iris and disposed in said trunk adjacent a first branch of said two branches and facing a second branch of said two branches, and a third deflector in the form of an iris and disposed in said trunk adjacent said second branch facing said first branch.

20. The phased array antenna system claimed in claim 19, wherein said first deflector is in the form of a wedge.

21. The phased array antenna system claimed in claim 19, wherein said first deflector is in the form of an iris.

22. The phased array antenna system claimed in claim 7 wherein at least some of the antenna elements are each coupled to two of said feed network circuits, one associated with said first polarization and another associated with said second polarization.

23. The phased array antenna system of claim 1 wherein said waveguide network component includes at least one waveguide power divider/combiner comprising:

a tee-junction having two branches extending from a single trunk; and an impedance matching system including a first deflector disposed between said two branches facing said trunk, a second deflector in the form of an iris and disposed in said trunk adjacent a first branch of said two branches and facing a second branch of said two branches, and a third deflector in the form of an iris and disposed in said trunk adjacent said second branch facing said first branch.

24. The phased array antenna system dlaimed in claim 23 wherein said first deflector is in the form of a wedge.

25. The phased array antenna system claimed in claim 23 wherein said first deflector is in the form of an iris.

26. An antenna element structure comprising:

a dual polarization octagonal patch antenna element having a first set of four sides having a first predetermined length and a second set of four sides having a second predetermined length different from said first predetermined length, each side belonging to the second set of four sides being placed between two adjacent sides belonging to the first set of four sides;

a horizontal feed for said antenna element; and a vertical feed for said antenna element, said horizontal feed and said vertical feed being formed integrally with said octagonal patch antenna element to thereby form two orthogonally polarized waves.

27. The phased array antenna system claimed in claim 26 wherein said horizontal feed, said vertical feed, and said antenna element are all formed on a same surface of a common dielectric base plate.

28. The phased array antenna system claimed in claim 26 wherein said horizontal feed and said vertical feed are situated underneath the antenna element, and are electromagnetically coupled to the antenna element.

* * * * *